US007445135B2

(12) United States Patent
Miyata et al.

(10) Patent No.: US 7,445,135 B2
(45) Date of Patent: Nov. 4, 2008

(54) CONTAINER AND PUSHER

(75) Inventors: Taneo Miyata, Matsubara (JP); Yasushi Hasui, Sakai (JP); Mikio Murakami, Sakai (JP); Hirofumi Fujiwara, Ichikawa (JP)

(73) Assignee: Sharp Chemical Ind. Co., Ltd., Osaka (JP)

( * ) Notice: Subject to any disclaimer, the term of this patent is extended or adjusted under 35 U.S.C. 154(b) by 89 days.

(21) Appl. No.: 10/496,124

(22) PCT Filed: Nov. 21, 2002

(86) PCT No.: PCT/JP02/12145

§ 371 (c)(1),
(2), (4) Date: May 20, 2004

(87) PCT Pub. No.: WO03/043908

PCT Pub. Date: May 30, 2003

(65) Prior Publication Data

US 2005/0006413 A1 Jan. 13, 2005

(30) Foreign Application Priority Data

Nov. 22, 2001 (JP) ..... 2001-357834

(51) Int. Cl.
*B65D 88/54* (2006.01)
*B65D 35/56* (2006.01)

(52) U.S. Cl. ..... 222/326; 222/570; 222/566; 222/105

(58) Field of Classification Search ..... 222/325–327, 222/566–572, 391, 192, 95, 105, 107, 386.5
See application file for complete search history.

(56) References Cited

U.S. PATENT DOCUMENTS

| | | | | | |
|---|---|---|---|---|---|
| 2,100,025 | A | * | 11/1937 | Douglas | 439/509 |
| 2,582,156 | A | * | 1/1952 | Peterson | 222/327 |
| 3,058,632 | A | * | 10/1962 | Stremmel | 222/567 |
| 3,076,225 | A | * | 2/1963 | Sherbondy | 425/87 |
| 3,439,839 | A | | 4/1969 | Schumann et al. | |
| 4,986,862 | A | | 1/1991 | Matsufuru | |
| 5,248,071 | A | * | 9/1993 | Ray | 222/568 |
| 5,301,835 | A | * | 4/1994 | Fulks et al. | 222/95 |

(Continued)

FOREIGN PATENT DOCUMENTS

| | | |
|---|---|---|
| DE | 19643664 | 5/1998 |

(Continued)

*Primary Examiner*—Kevin P. Shaver
*Assistant Examiner*—Stephanie E Tyler
(74) *Attorney, Agent, or Firm*—Birch, Stewart, Kolasch & Birch, LLP

(57) ABSTRACT

A container, which houses a liquid such as a sealant in a flexible pouch 11 in a sealed state, is provided with a spout 2 that is constituted by an extrusion nozzle 22 and a spout base member 21 and formed on one end thereof so that the extrusion nozzle 22 is fixed by sandwiching the vicinity of a hole 32*a* formed on one end face of an extruder 3 by a flange portion 21*c* of the spout base member 21 and a flange portion 22*c* of the extrusion nozzle 22, and an extruder 3*a* is arranged so that an adjusting member 322*b*, which controls the tilt of the nozzle 22, is allowed to protrude outward from a hole 322*a* of the extruder 3*a*.

15 Claims, 13 Drawing Sheets

U.S. PATENT DOCUMENTS

| | | | | | |
|---|---|---|---|---|---|
| 5,650,180 | A | * | 7/1997 | Kumada et al. | 425/376.1 |
| 5,678,731 | A | * | 10/1997 | Okamura et al. | 222/105 |
| 5,833,099 | A | | 11/1998 | Boaz et al. | |

FOREIGN PATENT DOCUMENTS

| | | | |
|---|---|---|---|
| EP | 0083802 | | 7/1983 |
| EP | 1 052 182 | A2 | 11/2000 |
| JP | 62-83579 | U | 5/1987 |
| JP | 63-186674 | U | 11/1988 |
| JP | 04 253671 | A | 9/1992 |
| JP | 5-75163 | U | 10/1993 |
| JP | 2001-106262 | A | 4/2001 |
| JP | 2001-225853 | A | 8/2001 |
| WO | WO-98/17548 | | 4/1998 |

* cited by examiner

Fig. 14 (B) BACKGROUND ART

CONTAINER AND PUSHER

TECHNICAL FIELD

The present invention relates to a container for housing a liquid such as an adhesive, for example, typically represented by a sealant, and also concerns an extruder that is suitably used for housing such a container and for extruding the content to a predetermined place by a predetermined amount each time.

BACKGROUND ART

In general, adhesives typically represented by sealants such as silicon sealants have been introduced to the market in a housed state in a cartridge 4 made of an injection molded body of a resin, as shown in FIG. 13 in its cross-section, and upon application, the adhesive is used while being extruded by a predetermined amount each time, by using an extruder 3 that is referred to as a coking gun and commercially available, as shown in FIG. 14(A) in its external view and FIG. 14(B) in its cross-sectional view of the essential portion.

The cartridge 4 has a structure in which a cylinder-shaped outlet 42 is attached to one end of a cylinder portion 41 as an integral part, with a movable bottom 43 capable of freely rocking with respect to the inner face of the cylinder portion being attached to the other end, and the opening inside the outlet 42 is sealed with an aluminum foil 44, which is torn before the application. Moreover, a male screw 42*a* is formed on the periphery of the outlet, and a nozzle (not shown), which is a cone-shaped cylinder member, is engaged with the male screw 42*a*, and the nozzle is cut at a position that provides a desired opening diameter, and attached to the extruder.

The extruder 3, for example, shown in FIG. 14 is that of a closed type, and is mainly constituted by a cylinder 31 that is a main body of the extruder 3 with the two ends thereof opened, a lid member 32 with a through hole 32*a* formed therein that is freely detachably attached to one of the ends, and a supporting member that supports a trigger mechanism 33 for shifting a plunger 34 that is placed inside the cylinder 31 so as to freely rock therein, and closes the other end of the cylinder 31. Here, reference numeral 34*a* represents a guide that is fitted to the rod of the plunger 34 in a manner so as to relatively shift thereon. Upon application, the lid member 32 is removed, and after the cartridge 4 has been inserted into the cylinder 31 with its outlet 42 facing the lid member 32 side, the lid member 32 is attached, with the outlet 42 being allowed to face outside from a through hole 32*a* of the lid member 32. In this state, the plunger 34 is moved toward the lid member 32 side by operating a trigger 33. Thus, the plunger 34 is allowed to press the movable bottom 43 so that the content such as a sealant inside the cartridge 4 is extruded from the outlet 42.

With respect to the extruder, in addition to that of the closed type with a cylinder as shown in FIG. 14, that of an open type having a semi-cylinder shape with the upper half portion being opened is also commercially available.

DISCLOSURE OF INVENTION (Technical Problems to be Solved by the Invention)

The conventional cartridge as described above has a problem in that the volume thereof is unchanged even after the content has been consumed to cause high costs required for disposal of the container in compliance with the containers and packaging recycling law. Moreover, another problem of the conventional cartridge is that the movable bottom has to be attached to the inside of the cylinder portion having an integrally molded outlet in an air-tight state, resulting in high manufacturing costs. Here, in the case of a fixed spout, upon extruding the content, it becomes possible to easily extrude the content onto a predetermined position.

The present invention has been devised to solve the above-mentioned problems, and its objective is to provide a container which allows its empty container to be easily disposed so that it is possible to greatly reduce the costs for the disposal, and also to cut manufacturing costs greatly, in comparison with the conventional cartridge, and which upon application, makes it possible to extrude the content such as a sealant under the same workability as the conventional cartridge, and an extruder that is suitably used for extruding the content in such a container.

(Means to Solve the Problems)

In order to achieve the above-mentioned objectives, the container of the present invention, which is a container that houses a liquid such as an adhesive, and allows the liquid to be extruded by an extruder by a predetermined amount each time, is provided with a pouch prepared by forming a film-shaped material into a bag shape and a spout attached to one end of the pouch, and the spout is constituted by a spout base member that has a flange portion to be bonded to the pouch formed on one end of its cylinder portion with a male screw formed on the periphery thereof, and an extrusion nozzle that has a cone-shaped cylinder body with female threads to be engaged with the male screw being formed on the inner circumferential face of the base end thereof and a flange portion being formed on the outer circumferential face of the base end, and in this arrangement, the above-mentioned pouch houses the content in a sealed state, and after the spout base member has been bonded thereto, a hole is formed at a position inside the cylinder portion of the base member, and the pouch to which the spout base member has been bonded is housed inside the extruder; thus, the male screw is engaged with the extrusion nozzle, with the spout base member being allowed to face outside through a hole formed on one end of the extruder, so that an end portion of the extruder in the vicinity of the hole is sandwiched by flange portions respectively formed on the extrusion nozzle and the spout base member (invention 1).

In the container of the present invention, in place of the above-mentioned extrusion nozzle, an extrusion nozzle having an arrangement, in which female threads to be engaged with a male screw formed on the spout base member are formed on the inner circumferential face of the base end of the cone-shaped cylinder body and a flange portion having a shape to be freely detachably fitted to the hole of the extruder is formed on the outer circumference of the base end, may be used (invention 2).

Alternatively, the container of the present invention, which is a container that houses a liquid such as an adhesive, and allows the liquid to be extruded by an extruder by a predetermined amount each time, is provided with a pouch prepared by forming a film-shaped material into a bag shape and a spout attached to one end of the pouch, and the spout is constituted by a spout base member that has a flange portion to be bonded to the pouch formed on one end of a cylinder body, and an extrusion nozzle that has a cone-shaped cylinder body with the inner circumferential face of the base end being formed into a shape to be fitted to the cylinder body and a flange portion being formed on the outer circumferential face of the base end, and in this arrangement, the above-mentioned pouch houses the content in a sealed state, and after the spout base member has been bonded thereto, a hole is formed at a position inside the cylinder portion of the base member, and the extrusion nozzle is fitted to the cylinder body of the spout base member and the pouch to which the spout has been bonded is housed inside the extruder; thus, the extrusion nozzle is allowed to face outside through a hole formed on one end of the extruder so that the flange portion formed on the extrusion nozzle is made in contact with the vicinity of the hole of the extruder (invention 3).

The extruder of the present invention, which is provided with a cylinder-shaped main body that houses a container that is filled with a liquid such as an adhesive and has a nozzle for extruding the content attached to one end thereof so as to protrude therefrom, and has a hole for allowing the nozzle to face outside formed in one end thereof, and an extrusion-use plunger that is shifted inside the cylinder-shaped main body by a manual operation, is characterized in that an adjusting member, which covers the peripheral portion of the nozzle of the container to adjust the tilt of the nozzle, is formed on the periphery of the hole in a manner so as to protrude outward (invention 4). The plunger may be shifted by an air driving process in place of the manual operation.

In the extruder of the present invention, another structure in which the adjusting member is formed on an adapter that is freely detachably attached to one end of the cylinder-shaped main body may be adopted (invention 5).

In the present invention, in place of the conventional cartridge having a movable bottom placed inside a rigid cylinder body, a sealant is housed in a pouch having flexibility as a whole, and the structure of the spout formed at one end of the pouch is fixed to the extruder, or the unstableness of the spout formed at one end of the pouch is controlled by the adjusting member placed on the extruder; thus, it becomes possible to achieve the aforementioned objective of the invention.

In other words, in the container of the present invention, a liquid such as a sealant is housed in a flexible container such as a pouch prepared by forming a film-shaped material into a bag shape with a spout being attached to one end thereof, and a flange portion formed on an extrusion nozzle that forms the spout and a flange portion formed on a spout base member are allowed to sandwich the vicinity of a through hole that is used for allowing the spout to face outside, and this state is fixed through a screw engagement. The through hole may be conventionally formed in one end face of the main body of an extruder of a closed type. Thus, although the pouch serving as the container main body is a flexible member, the unstableness of the spout is eliminated even when the spout is made in contact with an application face upon applying the sealant or the like so that the viscous liquid such as the sealant that is the content can be extruded by a required amount each time under the same workability as the conventional cartridge. Further, it has been confirmed through experiments that the content can be virtually extruded without any remaining portion. Since the main body of the container of the present invention is prepared as the flexible pouch, the size of the container after the extrusion of the content is greatly reduced in comparison with the conventional rigid cartridge, and the costs required for the disposal thereof are also greatly reduced; thus, it becomes possible to greatly reduce the manufacturing costs thereof.

The container of the present invention in accordance with invention 2 is constituted by the above-mentioned pouch, a spout base member that is bonded to one end thereof and an extrusion nozzle that is engaged by this spout base member. This extrusion nozzle is allowed to face outside through a hole that is used for exposing the spout formed on one end face of a cylinder-shaped main body of the extruder of a conventional closed type. A flange portion is formed on the base end portion of the extrusion nozzle so as to be freely detachably fitted into the hole so that the unstableness of the extrusion nozzle can be controlled by allowing the flange portion to be fitted to the hole. Thus, the unstableness of the extrusion nozzle is eliminated even when the extrusion nozzle is made in contact with an application face upon applying the sealant or the like, thereby making it possible to provide a good application property.

In accordance with the container relating to invention 3 of the present invention, the spout base member is bonded to one end of the pouch, and the extrusion nozzle base end is fitted to the spout base member with the peripheral portion of the base end being formed with a flange portion thereon, thus the spout is attached thereto. The pouch is housed in an extruder of a conventionally-used closed type, and the extrusion nozzle that is the spout attached to the pouch is exposed from a through hole formed in one end face of the extruder. When the plunger of the extruder is shifted in an extruding direction of the content of the pouch in this state, the flange portion formed on the extrusion nozzle is made in close-contact with the end face in the proximity of the through hole of the extruder so that it is possible to control the extrusion nozzle from tilting. With this arrangement, upon application of the sealant or the like, even when the content is extruded with the extrusion nozzle being pressed thereon, it is possible to prevent the extrusion nozzle from tilting, and consequently to provide a superior applying property.

The extruder of the present invention is an extruder that is suitably used for extruding an adhesive or the like in the container using the pouch by a predetermined amount each time; therefore, by using the extruder of the present invention, it becomes possible to provide a superior applying property without the unstableness of the spout, without the necessity of using a container having the above-mentioned arrangement in which flange portions are formed on the extrusion base member and the extrusion nozzle so as to be fixed to the end of the extruder.

In other words, in the extruder, an adjusting member used for controlling the tilt of the nozzle is formed in a manner so as to protrude outward on the periphery of the hole that is formed in one end of the cylinder-shaped main body so as to allow the spout nozzle of the present invention to face outside. With this arrangement, even when the spout bonded to the pouch is made in contact with the application face, it is possible to avoid the unstableness of the spout.

In addition to the extruder of the closed type having a cylinder-shaped main body, the extruder of the present invention may have an arrangement in which a semi-cylinder-shaped cylinder is covered with a lid member to virtually form a cylinder-shaped main body; thus, the extruder is also applicable to an extruder of a so-called semi-closed type.

DETAILED DESCRIPTION OF THE INVENTION

Embodiments of the Present Invention

Referring to Figures, the following description will discuss embodiments of the present invention.

FIG. 1 is an explanatory drawing of an embodiment of a container of the present invention, which is a perspective view that shows a state when inserted in an extruder. FIG. 2 is a cross-sectional view that shows the vicinity of the spout when the container of the present invention is inserted to the extruder.

As shown in FIG. 1, a pouch 11 is a bag having a ship-bottom shape, and is made from a film material, so that it is flexible. A liquid such as a sealant and an adhesive is sealed in the pouch 11. The film material to be used here needs to prevent invasion of various gases so as to prevent the sealed content from curing and deteriorating. For this reason, a composite material formed by laminating films of several kinds is used.

In the case when, for example, the content is a silicone-based sealant that reacts with water to be polymerized and cured, a PET or nylon film is used as a base member, an aluminum foil is used as a barrier layer to water, and a polyethylene or polypropylene film is used as a seal layer; thus, a laminated film of a three-layer structure is preferably used. However, the materials to be used are appropriately selected depending on the content, and with respect to the structure, any structure may be used as long as at least not less than one layer is included therein.

With respect to the shape of the pouch of the present invention, any desired shape may be used as long as it allows the content to be extruded by an extruder or the like without any remaining portion; and among various shapes, a pouch having a ship-bottom shape and a standing pouch are preferably used from the viewpoints of easiness in handling the container and good workability.

As shown in FIGS. 1 and 2, a spout 2 is constituted by a spout base member 21 and an extrusion nozzle 22. The extrusion base member 21 has a structure in which a flange portion 21*c* is formed on one end of a cylinder portion 21*a* having a circumferential face that is formed into a male screw 21*b*, with the flange portion 21*c* having a adhesive layer to be bonded to the pouch 11 formed on the surface thereof. The extrusion nozzle 22 has a structure in which female threads 22*b* to be engaged with the male screw 21*b* of the spout base member 21 are formed on the inner circumferential face of the base end of the cone-shaped cylinder body 22*a*, with a flange portion 22*c* being formed on the circumference of the base end. Upon application, the tip of the cylinder portion 22*a* is cut at a desired position so as to provide a desired opening diameter.

This pouch 11 is housed in an extruder 3 as shown in FIG. 1 that has been conventionally used, and is used upon application. More preferably, as shown in FIGS. 1 and 2, an extruder in which a round recessed portion 32*b* is formed on the periphery of a through hole 32*a* that is used for exposing the nozzle to the outside is preferably used.

Upon application, a lid member 32 of the extruder 3 is removed, and the pouch 11 is inserted into the cylinder 31. At this time, the spout base member 21 has been bonded to the pouch 11, and the pouch is inserted with the spout base member 21 facing the lid member 32 side. After the insertion, the lid member 32 is attached. Thus, the spout base member 21 is allowed to face outside from the through hole 32*a* of the lid member 32. After a hole has been formed in the pouch 11 that is placed inside the spout base member 21, the extrusion nozzle 22 is screwed onto the female threads 21*b* of the spout base member 21. Both of the flange portions 21*c* and 22*c* of the spout base member 21 and the extrusion nozzle 22 have diameters greater than that of the through hole 32*a*. Therefore, by screwing the extrusion nozzle 22 thereto, the lid member 32 is sandwiched by the flange portions 21*c* and 22*c* on the periphery of the through hole 32*a* so that the spout 2 is fixed to the extruder 3. The flange portion 22*c* of the extrusion nozzle 22 is designed to have a diameter slightly smaller than that of the recessed section 32*b* formed on the periphery of the through hole 32*a* of the lid member 32; thus, in the state in which the extrusion nozzle 22 has been attached to the spout base member 21, the flange portion 22*c* is fitted to the inside of the recessed section 32*b*.

In the above-mentioned state, the cylinder body 22*a* of the extrusion nozzle 22 is cut at an appropriate position, and when the trigger 33 is operated, the plunger 34 (see FIG. 12) is shifted toward the lid member 32 side so that the pouch 11 is pressed inside the closed cylinder 31. By this pressing operation, the viscous fluid such as a sealant inside the pouch 11 is extruded outside through the hole formed inside the spout 2, and allowed to flow outside from the tip opening of the extrusion nozzle 22. Since the pouch 11 is flexible, it is gradually deformed with wrinkles as the plunger 34 advances to extrude the content outside so that finally, virtually all the content is extruded. At this time, in order to extrude the content to a predetermined position appropriately, the worker tends to press the tip of the extrusion nozzle 22 onto the application face; however, since the vicinity of the through hole 32*a* of the lid member 32 of the extruder 3 is sandwiched by the flange portion 22*c* of the extrusion nozzle 22 and the flange portion 21*c* of the spout base member 21, the spout 2 is fixed to the extruder 3, thereby making it possible to prevent the unstableness of the spout 2.

Moreover, with respect to the outlet formed in a conventionally-used cartridge, there are various sizes and shapes thereof; therefore, as shown in an exploded perspective view of FIG. 3 and a cross-sectional view of an essential portion of FIG. 4, a structure in which the through hole 32*a* formed in the lid member 32 that corresponds to one end face of the extruder 3 is made greater so that an adapter 35 is freely detachably attached thereto has been proposed. Even in the case when an extruder of this type is used, the embodiment of the present invention is adopted in the same manner. In this case, the flange portion 21*c* of the spout base member 21 and the flange portion 22*c* of the extrusion nozzle 22 are used to sandwich the adapter 35 so that the spout 2 is fixed to the extruder 3 through the adapter 35; thus, it becomes possible to provide the same functions and effects as in the case of the extruder shown in FIGS. 1 and 2.

In the above-mentioned embodiment, the vicinity of the through hole 32*a* of the extruder 3 is sandwiched by the flange portion 22*c* of the extrusion nozzle 22 and the flange portion 21*c* of the extrusion base member 21 so that the spout 2 is fixed onto the extruder 3. In the present invention, another structure in which the extrusion nozzle, as it is, is fitted to the end of the extruder may be used. With respect to examples of this structure, FIG. 5 shows an exploded perspective view thereof, and FIG. 6 shows a cross-sectional view thereof. In this embodiment, female threads 222*b* are formed on the inner circumferential face of the base end of a cone-shaped nozzle portion 222*a* of the extrusion nozzle 222 with a flange portion 222*c* being formed on the outer circumferential face of the base end, basically in the same manner as the extrusion nozzle of the foregoing embodiment; however, the shape and structure of the flange portion 222*c* are different from those of the foregoing embodiment.

In other words, the flange portion 222*c* of this example is freely detachably attached and fitted to a through hole 32*a* formed in the lid member 32 of the extruder 3, as described below. The flange portion 222*c* is constituted by a disc-shaped engaging portion 222*d* that has an outer diameter greater than the inner diameter of the through hole 32*a* of the lid member 32, an insertion section 222*e* that has an outer diameter slightly smaller than the inner diameter of the through hole 32*a*, and is placed adjacent to the engaging portion 222*d*. and a disc-shaped stopper portion 222*f* that has an outer diameter slightly greater than the inner diameter of the through hole 32*a*, and is placed adjacent to the insertion section 222*e*; and in this arrangement, from the base end of the cone-shaped nozzle portion 222*a* toward the top, the engaging portion 222*d*, the insertion section 222*e* and the stopper portion 222*f* are aligned in this order.

A notch 32*c* having a square shape is formed on the periphery of the through hole 32*a* formed in the lid member 32 of the extruder 3. Upon attaching the extrusion nozzle 222 to the lid member 32 of the extruder 3, the extrusion nozzle 222 is pushed into the lid member 32 from the inside thereof so that the nozzle portion 222*a* of the extrusion nozzle 222 sticks out from the through hole 32*a*. In this case, since the notch 32*c* is formed on the periphery of the through hole 32*a*, the through hole 32*a* is appropriately deformed to allow the stopper portion 222*f* to pass through the through hole 32*a* so that the extrusion nozzle 222 is snap-fitted into the lid member 32. In contrast, upon removing the extrusion nozzle 222, the tip of the extrusion nozzle 222 is pushed into the lid member 32*a* from the outside toward the inside so that the through hole 32*a* is deformed in the same manner, thereby making it possible to remove the extrusion nozzle 222.

After the extrusion nozzle 222 has been attached to the through hole 32*a* of the lid member 32, the stopper portion 222*f* prevents the extrusion nozzle 222 from coming off the through hole 32*a*. When the extrusion nozzle 222 is subjected to such a force as to tilt it, the engaging portion 222*e* is made in contact with the vicinity of the through hole 32*a* of the lid member 32 to prevent the extrusion nozzle 222 from tilting. Thus, even when upon application, the extrusion nozzle 222 is pressed onto the application face, it is possible to provide a good applying property without the unstableness of the extrusion nozzle 222. In the case when the pouch 11 is housed into the extruder 3, after the extrusion nozzle 222 has been attached to the lid member 32, the spout base member 21 bonded to the pouch 11 is engaged with the extrusion nozzle 222, and the pouch 11 is housed into the cylinder-shaped main body 3 of the extruder 3. Upon taking the pouch 11 out of the extruder 3, after the lid member 32 has been removed from the cylinder-shaped main body 31 of the extruder 3, the extrusion nozzle 222 is rotated, and the spout base member 21 is removed; thus, it becomes possible to easily exchange the pouch 11 without carelessly fouling the hand.

The above-mentioned embodiment has exemplified a case in which the extrusion nozzle is thread-engaged with the spout base member, and at this time, the vicinity of the through hole of the extruder is sandwiched between the flange portion of the spout base member and the flange portion of the extrusion nozzle so as to prevent the unstableness of the extrusion nozzle; however, the container of the present invention is not intended to be limited by this structure, and another structure in which the extrusion nozzle is fitted into the spout base member may be used to achieve the aforementioned objectives. Referring to FIGS. 7 and 8, the following description will discuss an example of this structure. FIG. 7 is a perspective view that shows a state in which the pouch is housed in the extruder, and FIG. 8 is a cross-sectional view of an essential portion showing the vicinity of the spout when the pouch has been housed in the extruder.

In this example, the spout 2*a* is constituted by a spout base member 211 and an extrusion nozzle 221, and the spout base member 211 has a structure with a cylinder-shaped cylinder body 211*a* and a flange portion 211*c* formed on the base end portion of the cylinder body 211*a*. The extrusion nozzle 221 has a structure which includes a cone-shaped cylinder body 221*a* and a flange portion 211*c* that has a diameter that is larger than the diameter of a through hole 32*a* formed in the lid member 32 of the extruder 3, and slightly smaller than the inner diameter of the extruder 3, and is formed on the periphery of the base end of the cylinder body 221*a*, and the inner circumference of the base end of the cylinder portion 221*a* is formed into a shape and a size so as to be fitted into the outside of the cylinder body 211*a* of the spout base member 211.

Upon application, the lid member 32 of the extruder 3 that has been conventionally used is removed, the pouch 11 is housed in the cylinder-shaped main body 31 and the spout base member 211 is bonded thereto. A hole is formed in the pouch 11 portion inside the cylinder portion 211*a* by a screw driver or the like so that the extrusion nozzle 221 is fitted into the spout base member 211. Next, the cylinder-shaped main body 31 is covered with the lid member 32 that has been preliminarily removed so as to allow the extrusion nozzle 221 stand out from the extruder 3 through the through hole 32*a*.

In this state, the tip of the cylinder body 221*a* of the extrusion nozzle is cut at an appropriate position so as to provide a desired opening diameter, and the content is extruded from the extrusion nozzle 221*a* by operating the trigger 33. When the trigger 33 is operated, the plunger 34 (see FIG. 14) is allowed to advance toward the lid member 32 so that the spout 2*a* attached to the pouch 11 is pressed onto the lid member 32 together with the pouch 11. At this time, the flange portion 221*c* formed on the extrusion nozzle 221 has a diameter larger than the through hole 32*a* of the lid member 32 and a size that is slightly smaller than the inner diameter of the lid member 32 so that it is pressed onto the inner surface of the lid member 32 so as to closely contact the entire surface thereof. Upon application of the sealant or the like, the extrusion nozzle 221 is made in contact with the application face while the sealant or the like is being extruded; however, even when a force is imposed in a manner so as to tilt the extrusion nozzle 221 due to the contact with the application face, the flange portion 221*c* of the extrusion nozzle 221 is maintained in the closely-contact state to the inner face of the lid member 32 to prevent the extrusion nozzle 221 from tilting.

The following description will discuss an embodiment of an extruder of the present invention. FIG. 9 is an exploded perspective view that shows a state in which the container is housed in an extruder 3*a* of the embodiment of the present invention, and FIG. 10 is a cross-sectional view of a lid member of the extruder 3*a*. As shown in FIGS. 9 and 10, the extruder 3*a* is constituted by a cylinder body 31 used for housing a pouch 11 containing a sealant or the like and a trigger 33, and a lid member 322 having a through hole 322*a* formed therein so as to allow the extrusion nozzle 22 attached to the pouch 11 to protrude is freely detachably attached to one end of the cylinder portion 31. A plunger (not shown) is attached to the other end so that, when the trigger 33 is operated, the plunger is allowed to gradually advance toward the lid member 322.

This embodiment features that a cone-shaped cylinder body 322*b* is integrally formed on the lid member 322 in a manner so as to protrude outward. The inner face of this cylinder portion 322*b* is formed into virtually the same shape as the outer face shape of the extrusion nozzle 22 so as to enclose the extrusion nozzle 22 from the outside thereof; thus, it becomes possible to prevent tilting and rolling at the time of the application. Therefore, the use of this extruder 3*a* makes it possible to provide a good applying property without the necessity of preparing any countermeasures for preventing the unstableness of the spout 2 on the container side including the pouch 11 and the spout 2.

In the extruder of the present invention, a cone-shaped cylinder body may be formed in the adapter. FIG. 11, which shows an example of this structure, is a cross-sectional view that shows the vicinity of the lid member 31 in a state in which the container 1 is housed. In this structure, an adapter 321 is attached to the lid member 32, and a cone-shaped cylinder body 321*a* is integrally molded on this adapter 321 in the same manner as described above.

In this case, the adapter 321 is designed to be fitted to an end portion of the extruder, and in comparison with the extrusion nozzle 222 of FIG. 6, the above-mentioned cone-shaped cylinder body 321*a* is formed on the adapter 321 in place of the nozzle portion 221*a*, and except that the female threads 222*b* on the inner circumferential face on the base end side to be formed in the extrusion nozzle of FIG. 6 is no longer necessary, the adapter 321 has the same structure, and is detachably attached to the extruder in the same manner. The inner circumferential face of the cylinder portion 321*a* of course has virtually the same shape as the outer circumferential face of the extrusion nozzle 22, and is designed to enclose the extrusion nozzle 22 from the outside thereof and also to satisfy such a dimensional relationship as to prevent the generation of tilting and rolling at the time of application.

The flange portion 322*c* in this example can be freely detachably fitted to the through hole 32*a* formed in the lid member 32 of the extruder 3. The flange portion 322*c* is constituted by a disc-shaped engaging portion 322*d* that has an outer diameter greater than the inner diameter of the through hole 32*a* of the lid member 32, an insertion section 322*e* that has an outer diameter slightly smaller than the inner diameter of the through hole 32*a*, and is placed adjacent to the engaging portion 322*d* and a disc-shaped stopper portion 322*f* that has an outer diameter slightly greater than the inner diameter of the through hole 32*a*, and is placed adjacent to the insertion section 322*e*; and in this arrangement, from the base end of the cone-shaped cylinder body toward the tip thereof, the engaging portion 322*d*, the insertion section 322*e* and the stopper portion 322*f* are aligned in this order.

Upon application of the above-mentioned adapter, as explained by reference to FIG. 6, a lid member in which a notch 32*c* having a square shape is formed on the periphery of the through hole 32*a* formed in the lid member 32 of the extruder 3 is used.

The application of the extruder of the present invention makes it possible to control the unstableness of the spout in the extrusion nozzle portion; therefore, with respect to the spout to be bonded to the pouch 11, it is possible to eliminate the necessity of having to use such a structure as to be divided into the spout base member and the spout base member, and consequently to use an integrated member of these. FIG. 12 is a cross-sectional view showing an example of this structure. With respect to the extrusion nozzle 2*a* in this example, the flange portion 2*c* to be bonded to the pouch 11 is integrally formed on the base end side of the cone-shaped nozzle portion 2*b*, and an adhesive layer 2*d* is laminated on the flange portion 2*c*.

In the above explanation, the manual operation trigger is shown (FIGS. 1, 3, 5, 7, 9, and 14(A)) as a means for shifting the extrusion-use plunger; however, with respect to the means for shifting the extrusion-use plunger, an air driving mechanism may be used to shift the plunger in place of such a manual operation mechanism.

(Effects Superior to those of the Prior Art Technique)

In accordance with the container of the present invention, a main body of a container that houses a viscous liquid such as a sealant is formed by a pouch prepared by forming a flexible film into a bag shape to house the liquid in a closed state, and upon application, after the spout has been bonded to one end of the pouch, a hole is formed in the pouch on the inside thereof, and the spout is fixed onto the extruder by the extrusion nozzle and the spout base member thereof; therefore, in comparison with a conventional rigid cartridge housing a sealant or the like, it is possible to greatly cut the manufacturing costs thereof, to greatly reduce the size of the container after the use, and also to greatly cut the costs required for the disposal thereof. Even in the case when the flexible pouch is used as the container main body, upon application, the same workability as the conventional rigid cartridge is available since the spout is fixed to the extruder, and the content can be appropriately extruded to a target position.

In accordance with the extruder of the present invention, a cone-shaped cylinder body, which encloses the extrusion nozzle of the container, is attached to one end of the extruder so that the cylinder body controls the unstableness of the extrusion nozzle; therefore, it becomes possible to provide a good applying property without the necessity of preparing any countermeasures for preventing the unstableness of the spout to be attached to the pouch.

Figure 1:
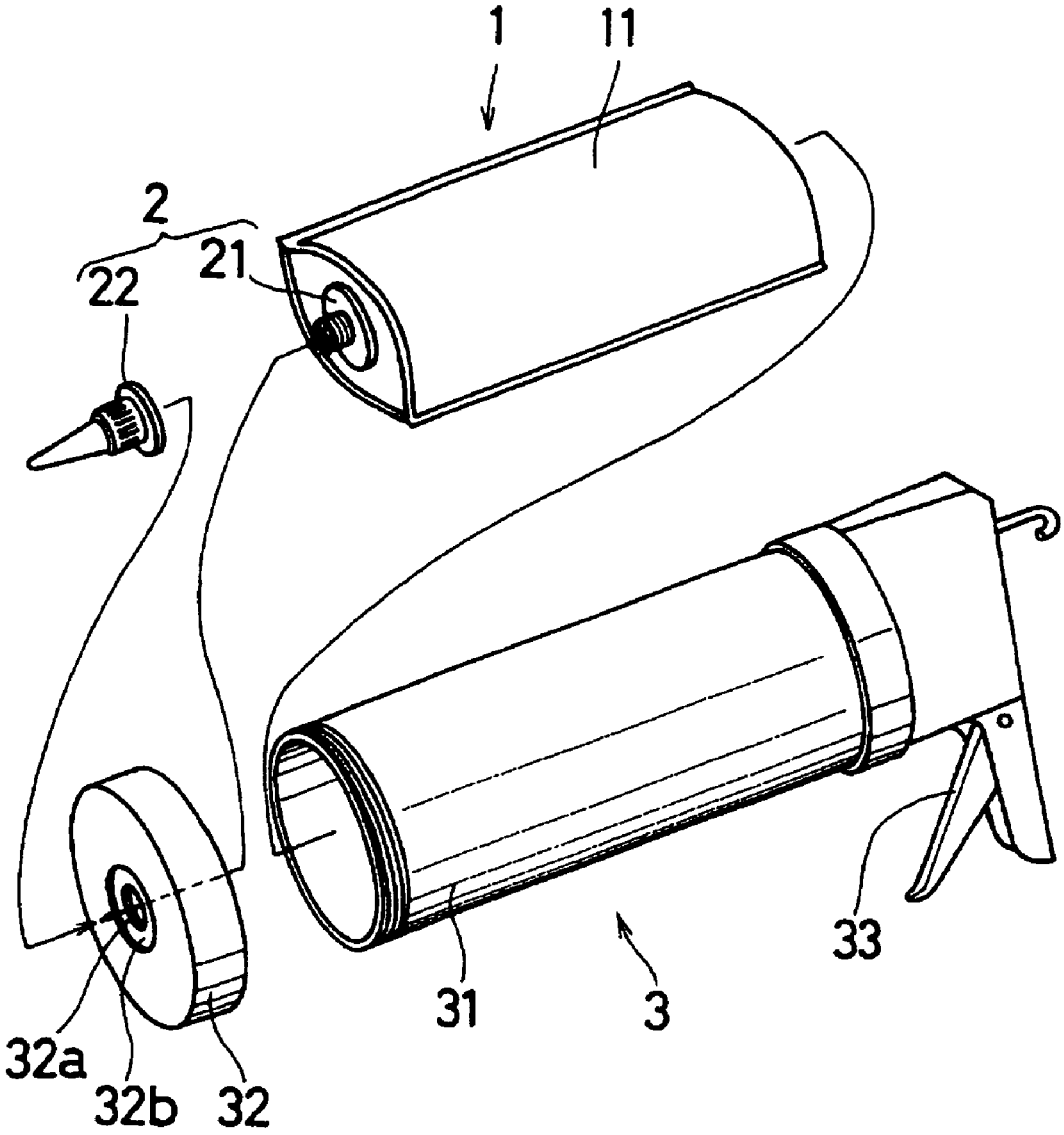
FIG. 1 is an exploded perspective view that shows a state in which a container in accordance with one embodiment of the present invention is housed in an extruder.
Figure 2:
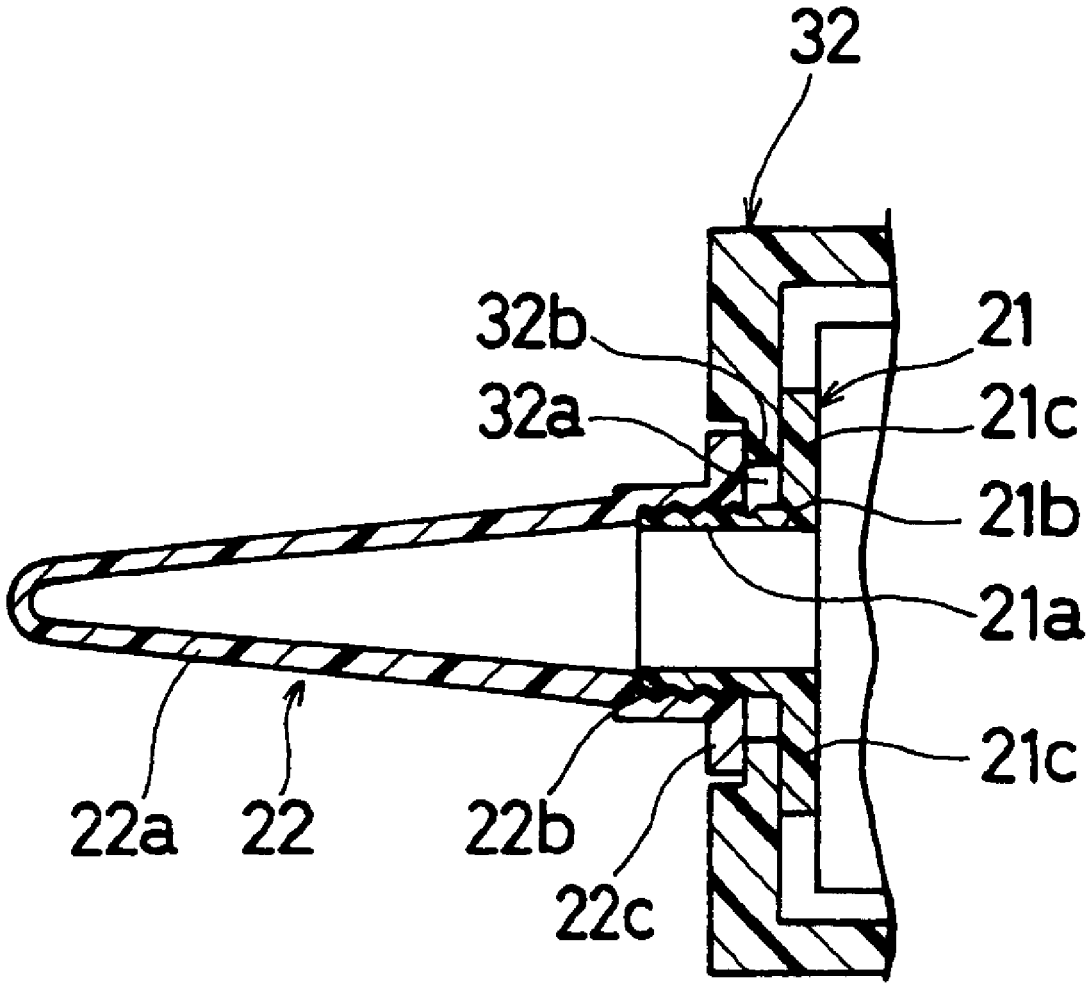
FIG. 2 is a cross-sectional view that shows the vicinity of a spout when the container of the embodiment of the present invention is housed in the extruder.
Figure 3:
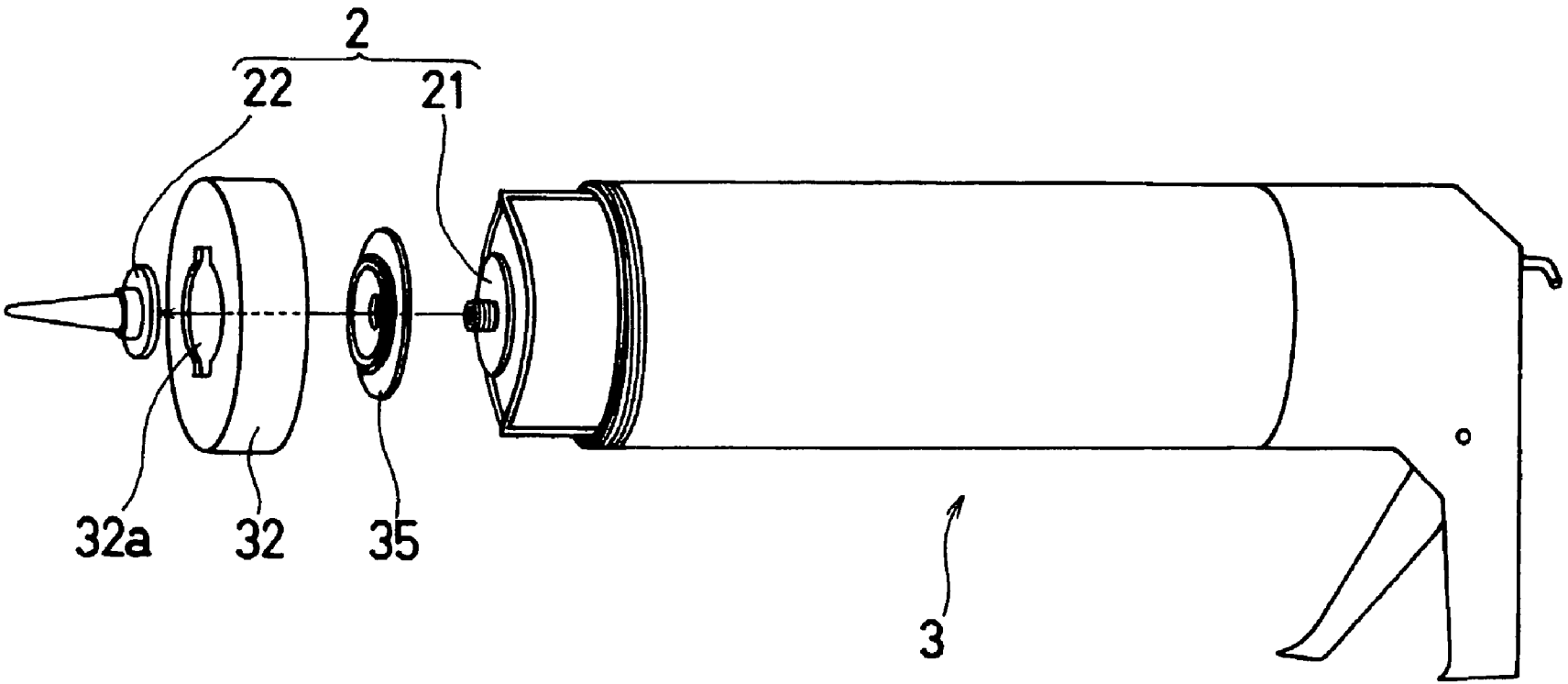
FIG. 3 is an exploded view that shows a state in which the container of the embodiment of the present invention is housed in an extruder having a lid member to which an adapter is attached.
Figure 4:
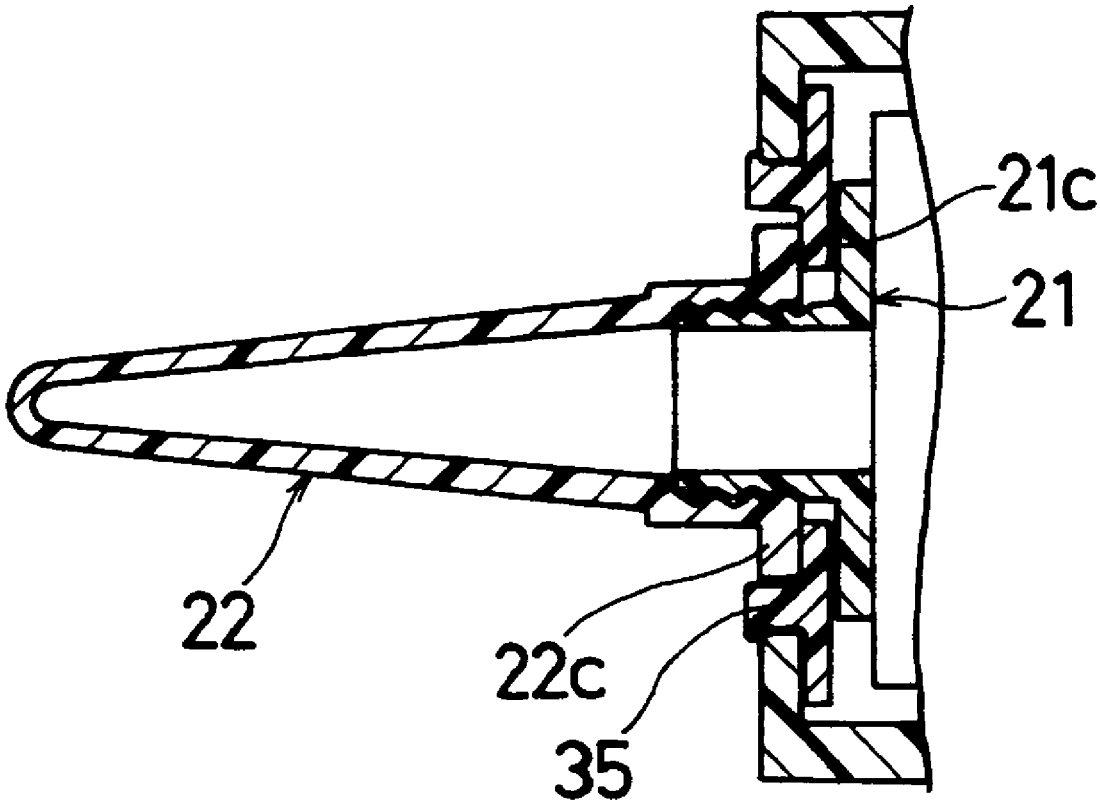
FIG. 4 is a cross-sectional view that shows the vicinity of a spout when the container of the embodiment of the present invention is housed in the extruder having a lid member to which an adapter is attached.
Figure 5:
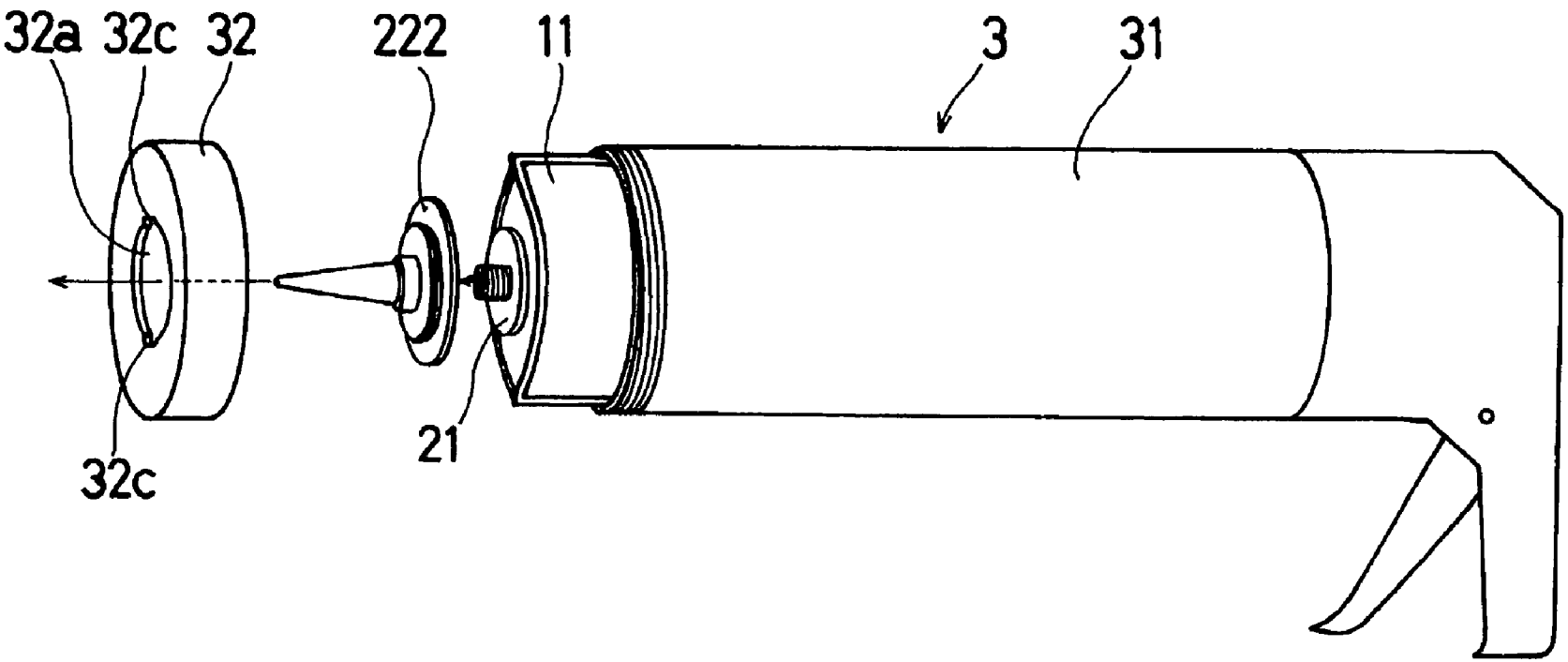
FIG. 5 is an exploded perspective view that shows a state in which a container in accordance with another embodiment of the present invention is housed in an extruder.
Figure 6:
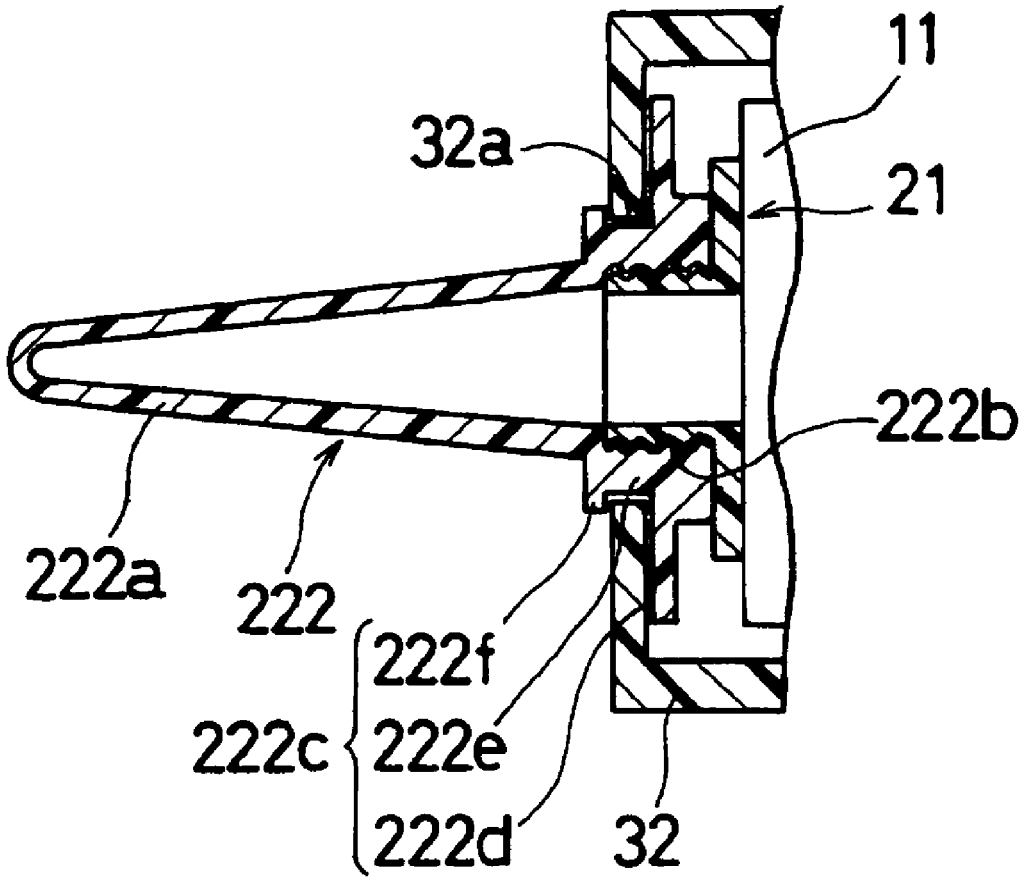
FIG. 6 is a cross-sectional view that shows the vicinity of a spout when the container of the embodiment of the present invention is housed in the extruder.
Figure 7:
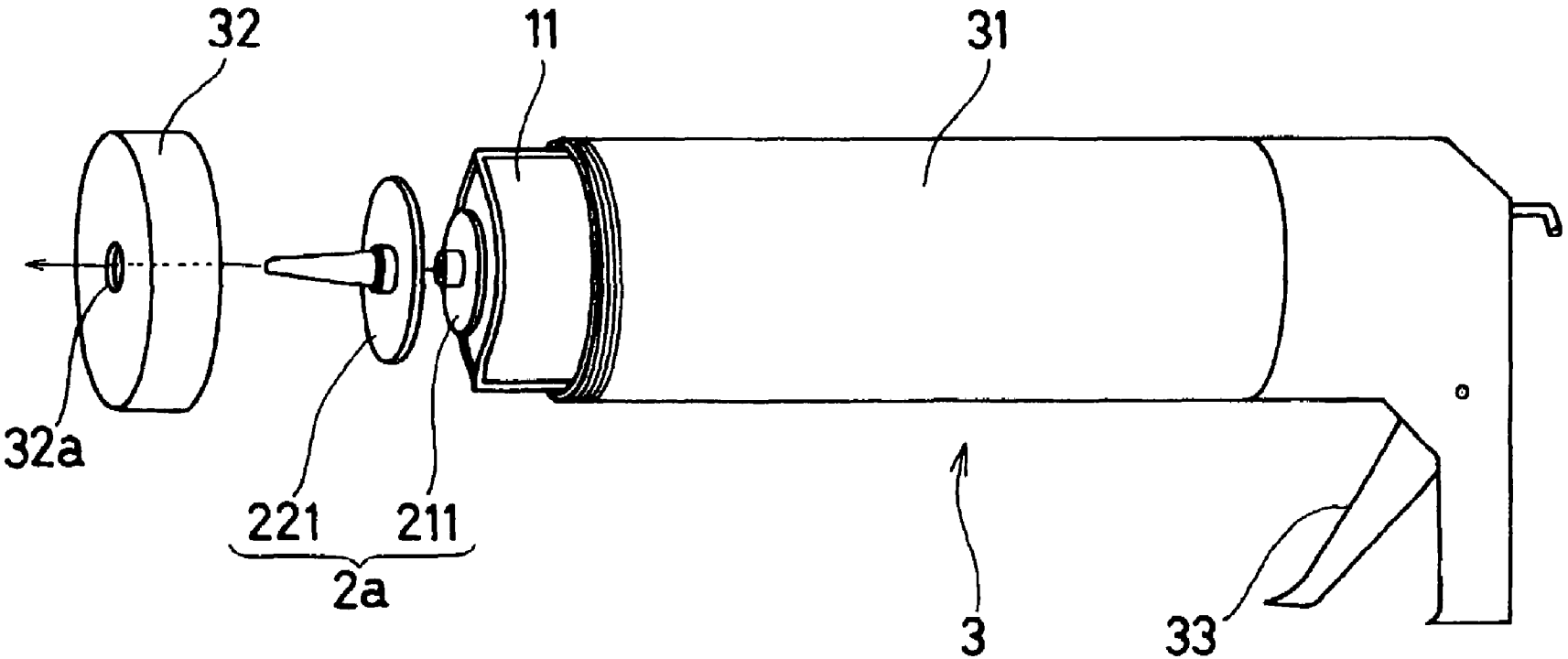
FIG. 7 is an exploded perspective view that shows a state in which a container in accordance with still another embodiment of the present invention is housed in an extruder.
Figure 8:
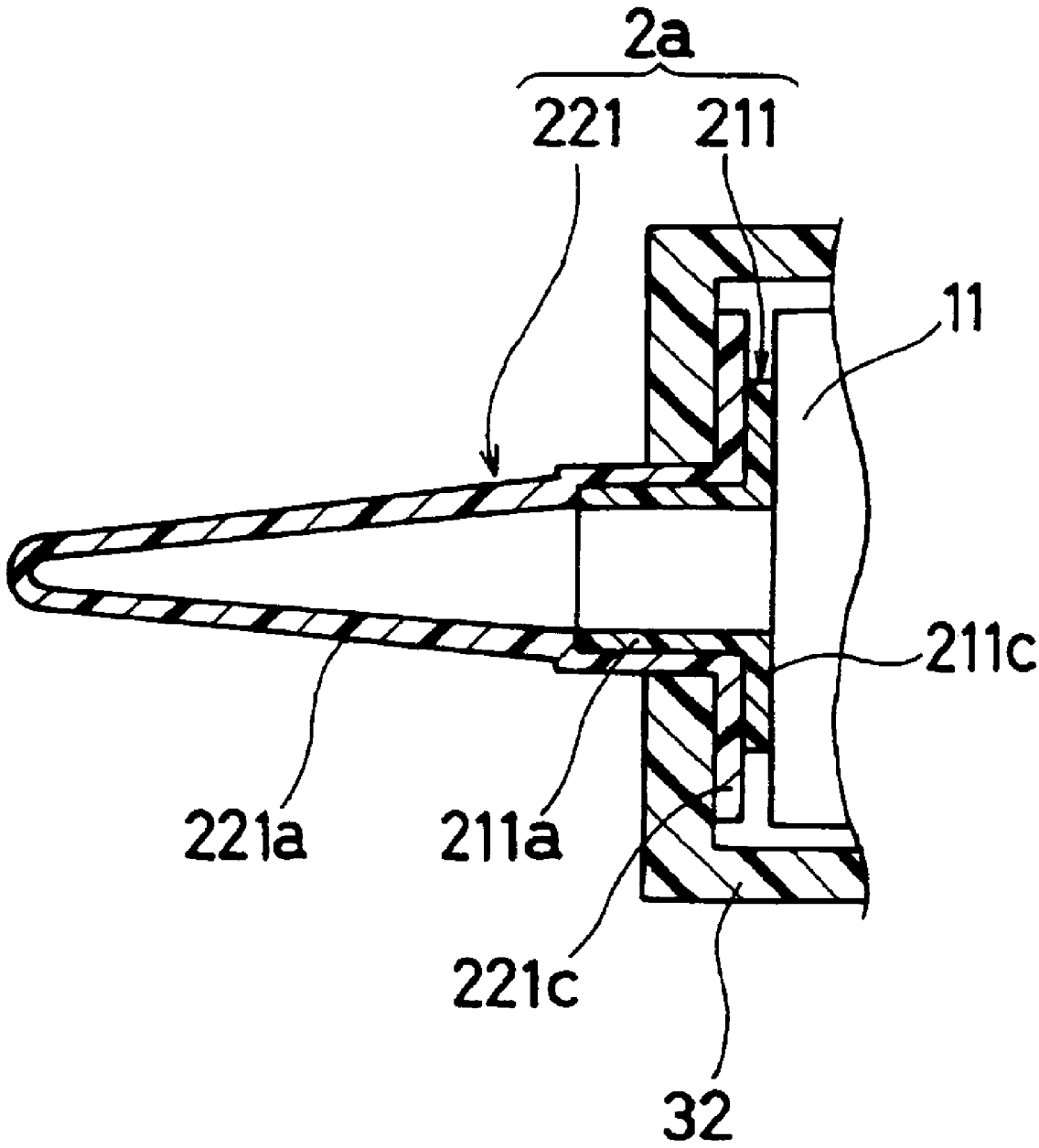
FIG. 8 is a cross-sectional view that shows the vicinity of a spout when the container of the embodiment of the present invention is housed in the extruder.
Figure 9:
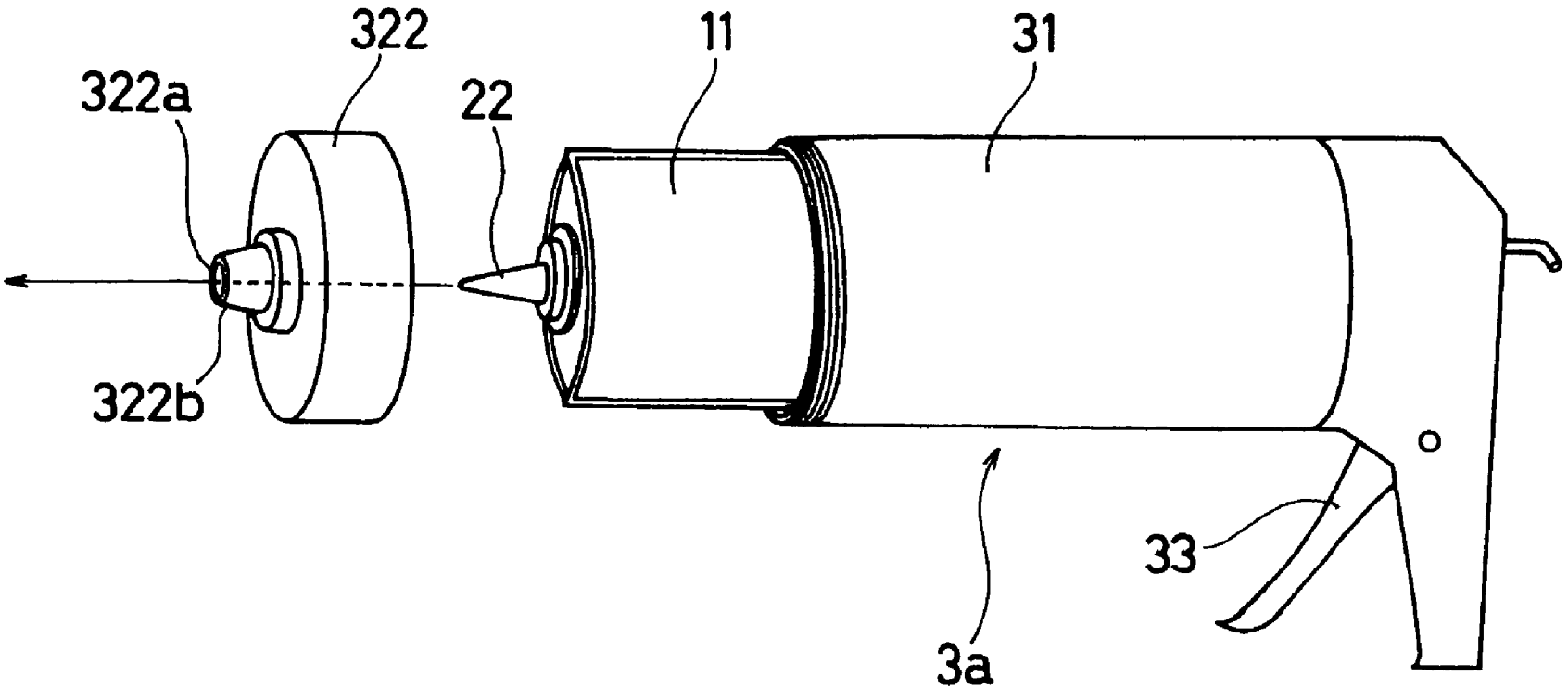
FIG. 9 is an exploded view that shows a state in which a container is housed in an extruder in accordance with one embodiment of the present invention.
Figure 10:
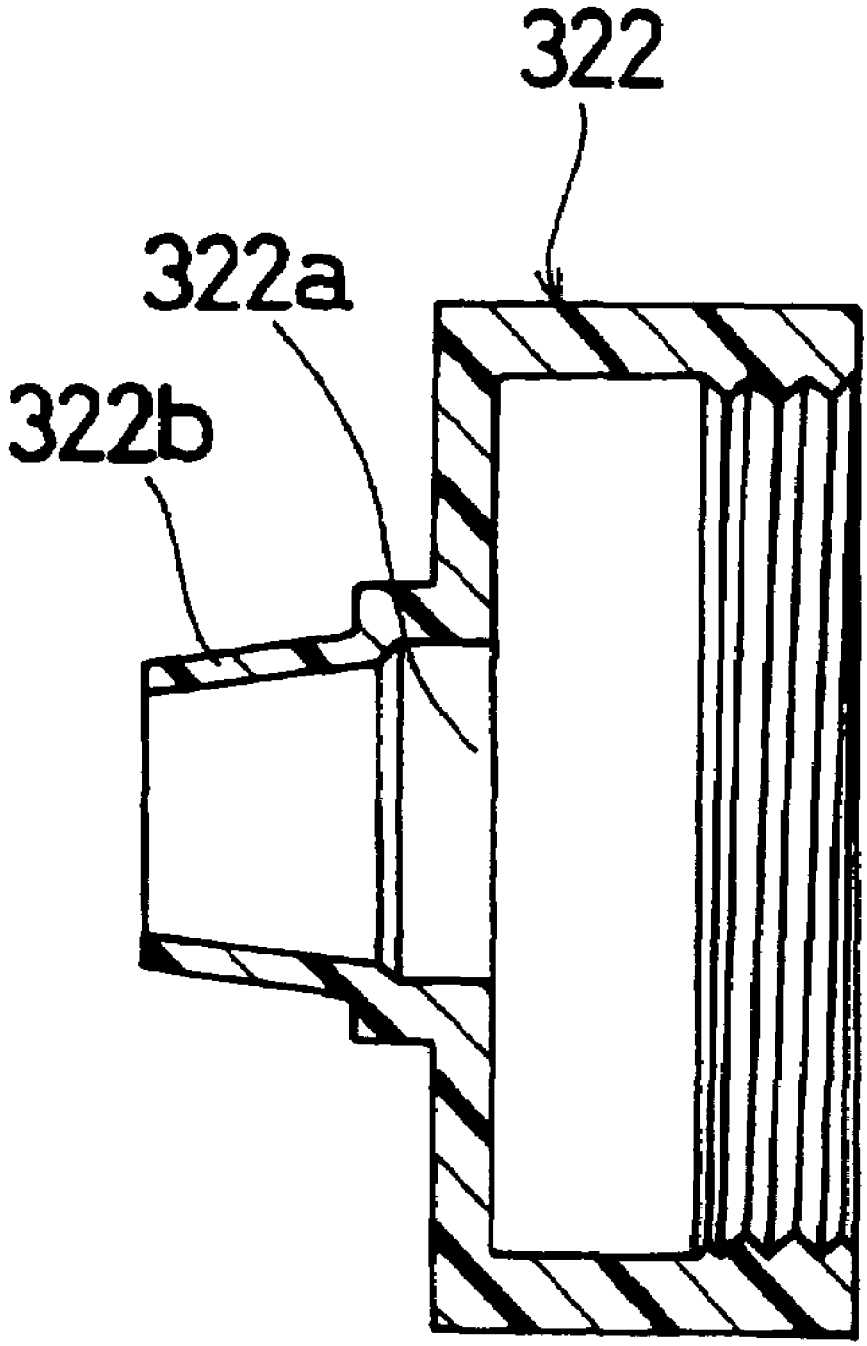
FIG. 10 is a cross-sectional view that shows a lid member of an extruder in accordance with still another embodiment of the present invention.
Figure 11:
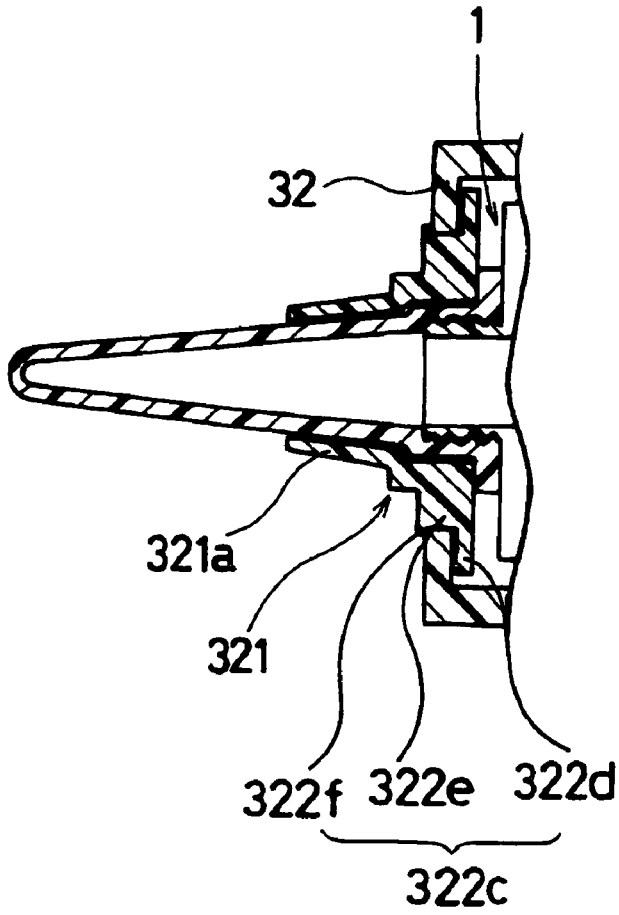
FIG. 11 is a cross-sectional view that shows the vicinity of a lid member, when a container is housed in an extruder having a lid member in accordance with the embodiment of the invention with an adapter on which a cone-shaped cylinder body is formed.
Figure 12:
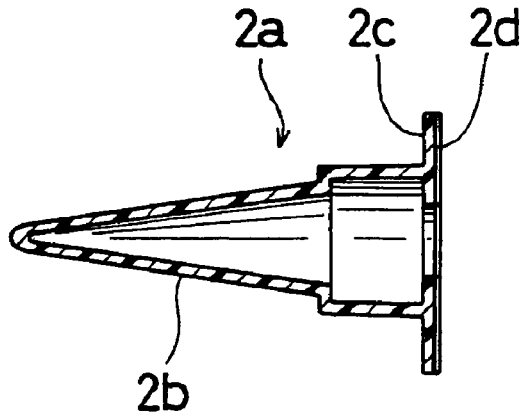
FIG. 12, which is an explanatory drawing showing another structural example of a spout of the present invention, shows a cross-sectional view of the spout in which a flange portion to be bonded to a pouch and an extrusion nozzle are integrally formed.
Figure 13:
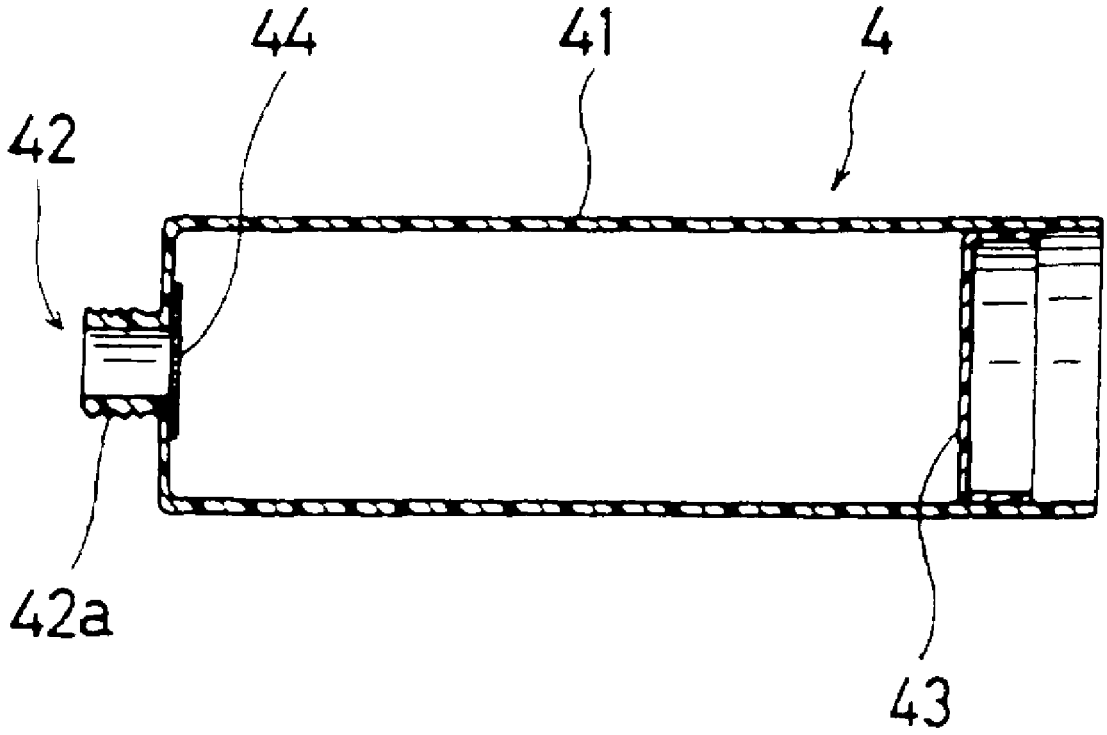
FIG. 13 is a cross-sectional view showing a structure of a cartridge that forms a container to house an adhesive such as a sealant so as to be freely extruded.
Figure 14:
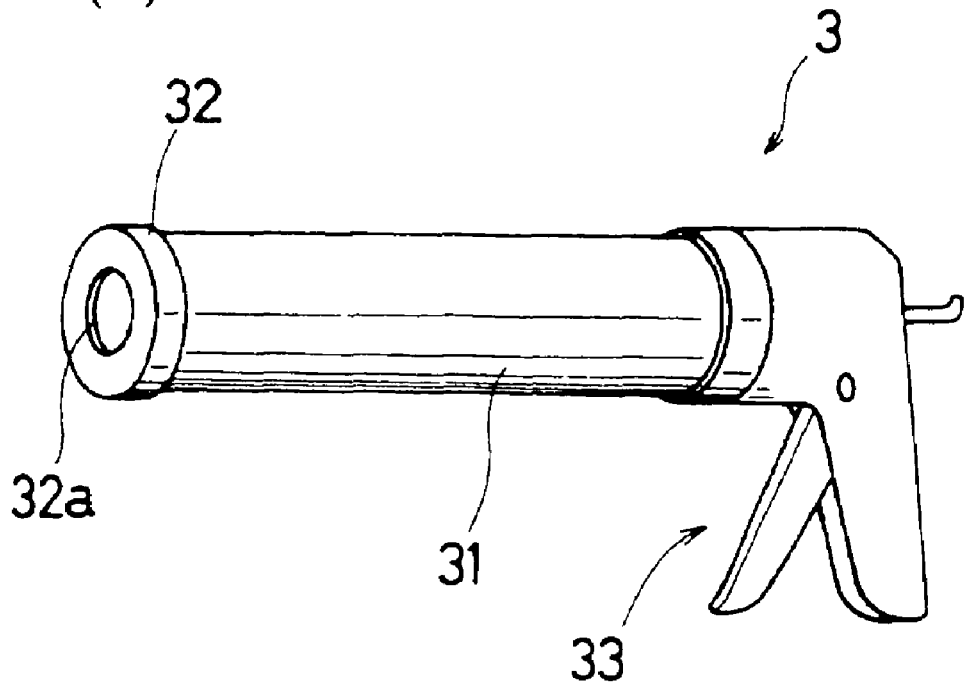
BACKGROUND ART Fig. 14 (A)
FIG. 14(A) is an appearance drawing that shows a structure of a commercial extruder used for extruding the content of a cartridge shown in FIG. 11.
FIG. 14(B) is a cross-sectional view showing an essential portion of FIG. 14(A).
Figure 14:
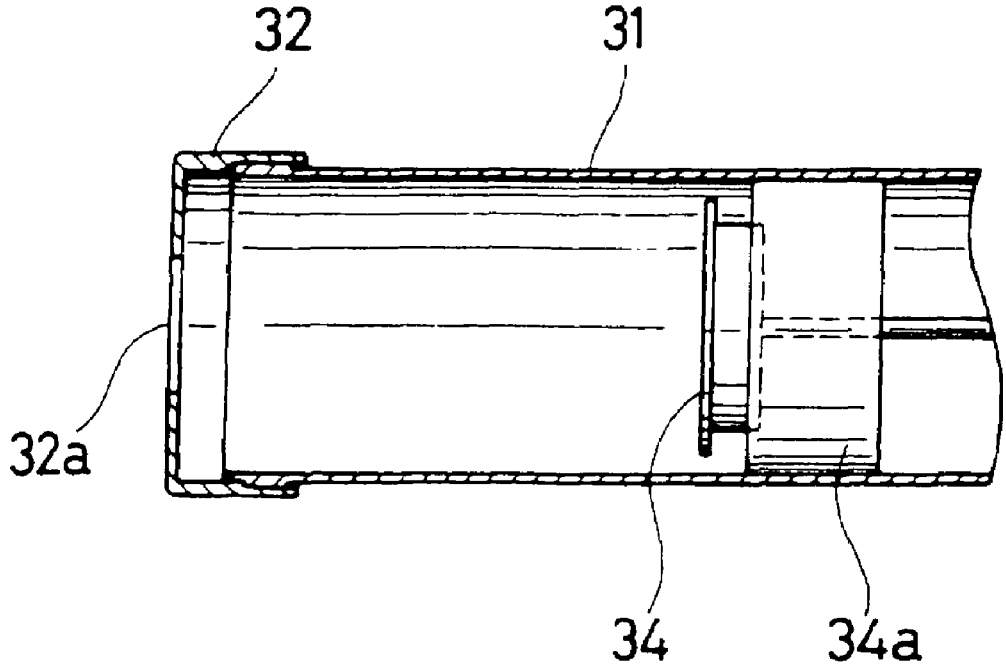
BACKGROUND ART Fig. 14 (A)

The invention claimed is:

1. An extruder comprising:

a cylinder-shaped main body for housing a container capable of being filled with a liquid, the cylinder-shaped main body having a hole formed in one end thereof;

a nozzle for extruding the liquid attached to the one end of the container and protruding though the hole so that the nozzle faces outside;

an extrusion-use plunger shifted inside the cylinder-shaped main body; and an adapter disposed on a periphery of the hole of the cylinder-shaped main body in a manner so as to protrude outwardly from inside the hole, wherein the adapter covers at least part of an outer peripheral portion of the nozzle in order to prevent tilting of the nozzle.

2. The extruder according to claim 1, wherein the adapter is freely detachably attached to the one end of the cylinder-shaped main body.

3. An extruder comprising:

a cylinder-shaped main body for housing a container capable of being filled with a liquid;

a nozzle for extruding the liquid attached to one end of the container so as to protrude therefrom, the cylinder-shaped main body including a hole through which the nozzle faces outside formed in one end thereof;

an extrusion-use plunger that is shifted inside the cylinder-shaped main body; and an adapter disposed so as to protrude outwardly from inside the hole, the adapter covering at least part of an outer peripheral portion of the nozzle in order to prevent tilting of the nozzle, the adapter is detachably attached to the cylinder-shaped main body and being fitted to the hole.

4. An adapter used for an extruder comprising:

a cylinder-shaped main body for housing a container capable of being filled with a liquid, a nozzle for extruding the liquid attached to a distal end of the cylinder-shaped main body, the nozzle engaging an inner surface of the distal end of the cylinder-shaped main body and protruding outwardly through a hole in the distal end of the cylinder-shaped main body;

a movable extrusion-use plunger inside the cylinder-shaped main body, the adaptor protruding outward from inside the hole, the adapter covering at least part of an outer peripheral portion of the nozzle in order to prevent tilting of the nozzle, and the adapter being detachably attached to the cylinder-shaped main body, and being fitted to the hole.

5. The extruder according to claim 3, wherein the adapter is freely detachably attached to the one end of the cylinder-shaped main body.

6. The adapter according to claim 4, wherein the adapter is freely detachably attached to the distal end of the cylinder-shaped main body.

7. The extruder according to claim 1, wherein the adapter includes an insertion section having an outer diameter slightly smaller than an inner diameter of the hole.

8. The extruder according to claim 3, wherein the adapter includes an insertion section having an outer diameter slightly smaller than an inner diameter of the hole.

9. The adapter according to claim 4, wherein the adapter includes an insertion section having an outer diameter slightly smaller than an inner diameter of the hole.

10. The extruder according to claim 1, wherein the adapter includes an engaging portion having an outer diameter larger than an inner diameter of the hole.

11. The extruder according to claim 3, wherein the adapter includes an engaging portion having an outer diameter larger than an inner diameter of the hole.

12. The adapter according to claim 4, wherein the adapter includes an engaging portion having an outer diameter larger than an inner diameter of the hole.

13. The extruder according to claim 1, wherein the nozzle extends further inwardly into the cylinder-shaped main body than does the adapter.

14. The extruder according to claim 3, wherein the nozzle extends further inwardly into the cylinder-shaped main body than does the adapter.

15. The adapter according to claim 4, wherein the nozzle extends further inwardly into the cylinder-shaped main body than does the adapter.

* * * * *